United States Patent [19]

Humphrey et al.

[11] 3,933,375

[45] Jan. 20, 1976

[54] BOOK COVER

[76] Inventors: Norman J. Humphrey, 17123 Sprenger, East Detroit, Mich. 48021; Lawrence A. Hages, Jr., 22449 Edmunton Drive, St. Clair Shores, Mich. 48036

[22] Filed: Mar. 24, 1975

[21] Appl. No.: 561,614

Related U.S. Application Data

[63] Continuation of Ser. No. 419,482, Nov. 28, 1973, abandoned.

[52] U.S. Cl. ..... 281/34; 229/92.5

[51] Int. Cl.[2] ..... B42D 3/04

[58] Field of Search ..... 281/34; 229/92.5, 92.7, 229/84

[56] References Cited

UNITED STATES PATENTS

| | | | |
|---|---|---|---|
| 198,322 | 12/1877 | Totten | 229/92.7 |
| 620,423 | 2/1899 | Custer | 229/92.5 |
| 873,024 | 12/1907 | Custer | 229/92.5 |
| 1,000,249 | 8/1911 | Flickinger | 229/84 |
| 1,957,926 | 5/1934 | Williamson | 281/34 |
| 2,935,337 | 5/1960 | Ecclestone | 281/34 |
| 3,174,244 | 3/1965 | Walton | 229/92.5 |

FOREIGN PATENTS OR APPLICATIONS

| | | | |
|---|---|---|---|
| 431,227 | 9/1911 | France | 229/84 |
| 452,325 | 8/1936 | United Kingdom | 281/34 |

*Primary Examiner*—Jerome Schnall
*Attorney, Agent, or Firm*—Harness, Dickey & Pierce

[57] ABSTRACT

The book cover is unique in that the unit can be sent in the normal manner through the mail as a card, and instead of being discarded when received, it is usable as a book cover for different thicknesses of books particularly those of the paperback type. The undesirable picture and title on the outer cover will be hidden. The cover folds into post card form and is secured by a tab disposed in an end slot, the tab being usable as a bookmarker when the cover is applied to a book.

2 Claims, 6 Drawing Figures

22
21
11
14
15
12
15
16
12'
13
17
18
19
17
4
4

20
25
26
23
24

17
13
19
18
32

31
21
29
28
Post Card
Michigan
27

27
Michigan
21

21
14
19
34
35
12

BOOK COVER

This is a continuation of application, Ser. No. 419,482, filed Nov. 28, 1973, now abandoned.

BACKGROUND OF THE INVENTION

While post cards and book covers have been used for many years as separate items, it is not believed that the two have been combined to be usable first as a post card by a sender and thereafter as a book cover by a receiver.

SUMMARY OF THE INVENTION

The invention pertains to a cut paper board sheet to provide a central body portion having pocket portion and a flap portion at opposite sides thereof. Scored lines are provided between the central body portion and the end pocket and flap portions so that books of different thicknesses can be enclosed within the cover. The end having the pocket portion receives the outer end of the front cover. The scored portion adjacent thereto extends over the book back with the central body portion extended over the back cover and the flap extending over the inner face thereof. A tab is cut from the central portion of the flap which functions as a bookmarker, a closure lock for the unit when used as a post card, and with an aperture in the end is used as a support on a display area.

The tab is inserted in a slot at the bottom of the pocket when retaining the body, pocket and flap in fixed facing relation to each other. The outer side of the pocket portion contains printed matter, pictures and the like as found on a postal card with the opposite side having a section for an address and a section for a message. The inside of the unit can also be used for sending written matter as in a letter. A rack is usually provided for supporting a plurality of the units on a projecting finger which receives the hole at the end of the tabs. The same or different pictures or display matter may be shown on the plurality of cut sheets so displayed.

DESCRIPTION OF THE PREFERRED EMBODIMENT

Figures 1, 2, 3, 4, 5, 6:
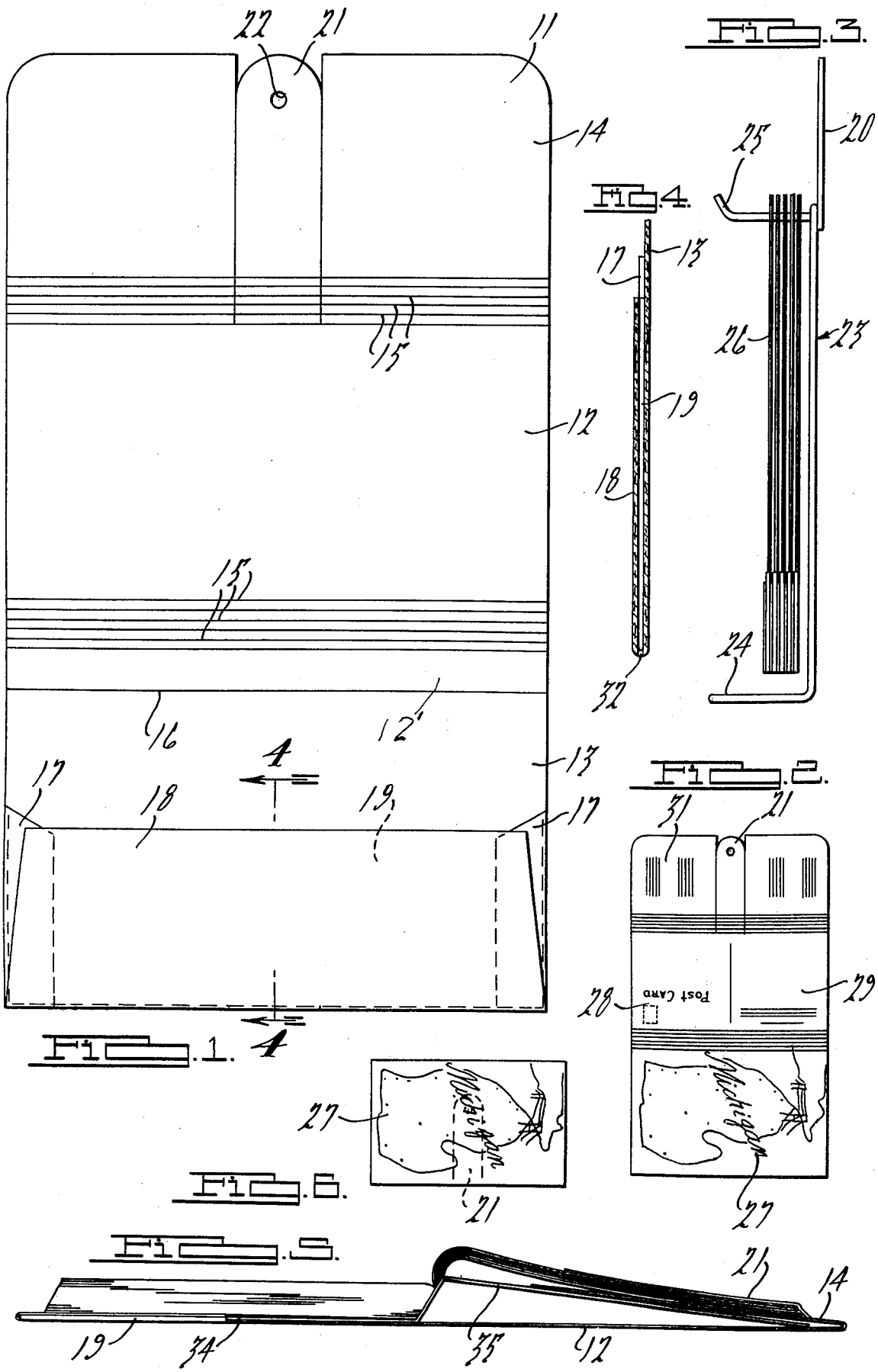
FIG. 1 is a view in elevation of a cut and scored sheet of paper board, showing one side thereof, which embodies features of the present invention.
FIG. 2 is a reduced view of the cut and scored sheet illustrated in FIG. 1, as viewed on the opposite side thereof.
FIG. 3 is a view of a rack having a plurality of the cut and scored sheet displayed thereon.
FIG. 4 is an enlarged sectional view of the structure illustrated in FIG. 1, taken on the line 4—4 thereof.
FIG. 5 is an end view of the cover illustrated in FIG. 1 applied to a book with some of the end pages in open position.
FIG. 6 is a view of the cut and scored sheet illustrated in FIG. 2, when folded in post card configuration.

A sheet of material 11 is cut to provide a central body portion 12', a front cover portion 13, a back cover portion 12 and an end flap portion 14. Between the portions a plurality of scored lines 15 are provided relative to a scored line 16 which is folded to form an edge of the cover at the back of the book. One of the scored line 15 is bent thereafter to provide a predetermined width to the back of the cover which varies depending upon the thickness of the book. The scored line 15 between the back cover portion and flap portion will be correspondingly bent to have the flap portion fold against the inner face of the back cover. The front cover portion 13 of the sheet has wings 17 cut from the sides and a flap 18 cut from the bottom. The flaps 17 are bent inwardly and the flap 18 is bent downwardly and adhered thereto to form a pocket 19. It is in this pocket that the front cover of the book is inserted after which the cut sheet is bent on the line 16 at one edge of the back and at one of the adjacent scored lines 15 at the other edge of the back. The corresponding scored line 15 at the other end of the back cover portion is then bent to dispose the flap portion 14 of the sheet against the inner face of the back cover of the book.

The flap portion 14 has a tab 21 cut therefrom and through the scored lines 15 and provided with an aperture 22 adjacent to its free end. As illustrated more specifically in FIG. 3, a rack 23 has a supporting base portion 24 and a projecting finger portion 25 which supports a plurality of the formed units 26 by threading the tabs 21 onto the projecting finger 25. The exposed face 27 of the units 26 has lettering, design, picture or a combination thereof provided thereon to form the postal card design. The exposed back cover portion has an area 28 for the address of the person to whom the card is to be sent and an area 29 for a message which is to be forwarded. The areas 31 of the flap portion can have a printed matter thereon describing a specific area in which the cards are being sold.

As illustrated in FIG. 4, the edge forming the bottom of the pocket portion 13 has a slot 32 therethrough which is slightly wider than the width of tab 21 for receiving the tab. When the flap position 14 is folded against the back cover portion 12 and the pocket portion 13 is folded there against, the tab 21 is inserted through the slot 32 to maintain the three portions in fixed relation so that the unit can be sent through the mail like any other post card. When the post card is received, instead of being discarded, it has a further attractive life when used as a cover for a book such as the standard paperback book which comes in a standard size but in various thicknesses. The thickness of the book is taken care of by the scored lines 15, select ones of which are bent in the manner pointed out hereinabove.

When used as a cover as illustrated in FIG. 5, the pocket 19 receives the front cover 34 of the book. The back cover portion 12 is disposed adjacent to the outside of the back cover 35 while the flap portion 14 is folded against the inside of the back cover 35. The tab 21 is used as a bookmark to indicate the last page used before the book was closed. The tab 21 is also used as a means for retaining the foldable section in abutted relation for mailing, and also a supporting means by which the units are displayed. The rack 23 supports a sales card 20 which advertises the combination post card and book cover or a book cover alone. The material of the cut paper board sheet can be made of different fibers or filaments to provide a sheet which is durable, one that can be written and printed upon and which will not rupture when bent on the score lines.

We claim:

1. In a book cover and post card combination, a sheet of paper board cut to provide a central body portion for the back of a book, front and back cover portions extending from opposite edges edges of said body portion for the covers of the book, the edge of the front cover portion opposite to the body portion being folded back upon itself to form an inner pocket, the edge of the back cover portion opposite to the body portion being folded back upon itself to form an inner flap, a first scored line between the body portion and the front cover portion which provides a width for the front cover portion which equals the width of the front cover of a book, a plurality of scored lines in said central body portion spaced from said first scored line, one of which folds to have the free edges of the front and back cover portions disposed in aligned relation, a plurality of scored lines located adjacent to and forming the fold between the back cover portion and said flap, a tab cut inwardly from the edge of said flap opposite said fold and extending through said last mentioned plurality of scored lines to form a book mark for extending between the book pages at the edge opposite to said central body portion, and postcard decorative printed matter on the exposed side of the front cover portion located opposite to the side having the pocket, said pocket having a slot in the outer closed edge for receiving said tab and retaining the flap against said pocket when the front and back cover portions are engaged when folded on said one scored line so that the book cover can be employed as a postal card a postcard indication with an area for an address and a stamp on the outer side of the back cover portion to be on the opposite side from the post card decoration printed matter when the cover portions are secured as a postcard.

2. In a book cover and post card combination as recited in claim 1, wherein after the front cover portion is folded on said first scored line the back cover portion is folded on one of the plurality of scored lines in said central body portion to cover the back portion of books of variable thickness, and folding the flap on a line located between the back cover portion and the flap to provide a cover which fits books of different thickness.

* * * * *